US012723771B2

(12) United States Patent
Li

(10) Patent No.: US 12,723,771 B2
(45) Date of Patent: Sep. 1, 2026

(54) INTELLIGENT CONTROL AND VENTILATION ENERGY-SAVING MUFFLER SYSTEM BASED ON CLOUD SYSTEM

(71) Applicant: Shenzhen Boheng Habitat Environment Co., Ltd., Shenzhen (CN)

(72) Inventor: Hong Li, Dongguan (CN)

(73) Assignee: Shenzhen Boheng Habitat Environment Co., Ltd., Shenzhen (CN)

( * ) Notice: Subject to any disclaimer, the term of this patent is extended or adjusted under 35 U.S.C. 154(b) by 388 days.

(21) Appl. No.: 18/530,344

(22) Filed: Dec. 6, 2023

(65) Prior Publication Data

US 2025/0093059 A1 Mar. 20, 2025

(30) Foreign Application Priority Data

Sep. 19, 2023 (CN) ..... 202311205764.X

(51) Int. Cl.
*F24F 13/24* (2006.01)
*F24F 11/46* (2018.01)
(Continued)

(52) U.S. Cl.
CPC ..... *F24F 11/46* (2018.01); *F24F 13/24* (2013.01); *F24F 2013/247* (2013.01);
(Continued)

(58) Field of Classification Search
CPC ..... F24F 11/46; F24F 13/24; F24F 2013/247; F24F 2110/10; F24F 2110/30; F24F 2130/40
See application file for complete search history.

(56) References Cited

U.S. PATENT DOCUMENTS

2012/0015597 A1* 1/2012 Foreman ..... F24F 11/49 454/239
2022/0303339 A1* 9/2022 Laughton ..... G06F 18/23
2023/0125880 A1* 4/2023 Analytis ..... F24F 11/523 236/1 C

FOREIGN PATENT DOCUMENTS

CN 209983202 U * 1/2020
CN 216240336 U * 4/2022
CN 218568423 U 3/2023

OTHER PUBLICATIONS (Shen, Gongtian & Zhang, Junjiao & Lackner, Gerald, (2020), International acoustic emission standard analysis and development outlook, Insight—Non-Destructive Testing and Condition Monitoring. 62. 724-734. 10.1784/insi.2020.62.12.724.) (Year: 2020).*

* cited by examiner

*Primary Examiner* — Michael W Choi
(74) *Attorney, Agent, or Firm* — JEEN IP LAW, LLC

(57) ABSTRACT

The present disclosure provides an intelligent control and ventilation energy-saving muffler system based on cloud system including a sensor, a communication equipment, a controller, a data processor, an internet cloud system, an electrical controller, and a cooling and noise reduction equipment. The present disclosure combines an optimal solution technology of heat emission, fresh air (intake and exhaust) system and noise emission in equipment operation. According to the aerodynamics and noise propagation and diffusion principle, the integrated design of online temperature and noise dynamic monitoring, data conduction, communication induction, joint control and regulation, automatic electrical control, an adaptive environment intelligent electric regulation control of heat dissipation and ventilation and noise reduction integrated information system is realized. Combined with the advantages of the Internet cloud
(Continued)

system, it can achieve real-time online monitoring, automatic control, remote guidance and service, fully reflecting the characteristics of high intelligence, information technology, efficient connectivity and controllability.

7 Claims, 6 Drawing Sheets

(51) Int. Cl.
*F24F 110/10* (2018.01)
*F24F 110/30* (2018.01)
*F24F 130/40* (2018.01)

(52) U.S. Cl.
CPC ..... *F24F 2110/10* (2018.01); *F24F 2110/30* (2018.01); *F24F 2130/40* (2018.01)

INTELLIGENT CONTROL AND VENTILATION ENERGY-SAVING MUFFLER SYSTEM BASED ON CLOUD SYSTEM

CROSS-REFERENCE TO RELATED APPLICATIONS

This application claims priority to Chinese Patent Application No. 202311205764.X, filed on Sep. 19, 2023, which is hereby incorporated by reference in its entirety.

TECHNICAL FIELD

The present disclosure relates to the technical field of intelligent information control for environmental protection, ventilation, noise reduction and energy-saving equipment, and in particular, to an intelligent control and ventilation energy-saving noise reduction system based on cloud system.

BACKGROUND

First of all, current products on the market are a single noise reduction material or product, only to meet the indicators of sound insulation and noise reduction, without considering the impact and solutions of thermal radiation or poor ventilation generated in the work of the equipment or the indoor environment. The heat dissipation in the continuous operation of the equipment or poor ventilation will cause a high temperature in the room, which will lead to the increase of equipment energy consumption, and then affect the function and life of the equipment itself.

In addition, once the sound insulation and noise reduction product are fixed, no adjustments can be made. It is a fixed building material, which cannot match the real-time state of the environment for optimal configuration and adjustment. Once the material or product is fixed and installed, the effect of its inspection is only through manual field testing, manual adjustment control, without automatic monitoring, system intelligent joint control, effect feedback and control improvement.

The most important: at present, there is no such a kind of innovative system based on intelligent information control technology and energy saving and environmental protection noise reduction technology to improve the accuracy and safety of noise reduction and energy saving efficiency, and finally realize the automation upgrade of an environmental protection noise reduction and energy saving intelligent manufacturing technology.

SUMMARY

A In view of this, the present disclosure is based on the most advanced intelligent information control technology and energy saving and environmental protection noise reduction technology combined innovation, optimal solution to wind, water cooling power or energy storage equipment (fan, new energy charging station energy storage equipment, large data center exchange unit, boiler and other equipment) in the operation of high heat, high wind resistance and high noise emissions caused by environmental pollution problems. It provides a kind of electric intelligent regulation control of heat dissipation and noise reduction ventilation that can automatically adapt to the dynamic environment, and a kind of environmental protection and energy saving technology that can ventilation temperature control and noise emission intelligent information control, and maximize the protection of the function and life cycle of the equipment and the health and comfort of the living environment.

To achieve the above purpose, the present disclosure provides the following technical solutions, which mainly include:

an intelligent control and ventilation energy-saving muffler system based on cloud system including the following functional components: a sensor, a communication equipment, a controller, a data processor, an internet cloud system, an electrical controller and a cooling and noise reduction equipment.

The intelligent control and ventilation energy-saving muffler system based on cloud system further includes a monitoring module, configured to dynamic monitor pressure, temperature and noise.

The sensor includes a pressure sensor, a temperature sensor, and a sound level meter sensor.

The communication equipment receives real-time data transmitted by the monitoring module and upload it to the internet cloud system.

The data processor stores Chinese and international noise emission standard data and includes a temperature data storage; an artificial intelligence, a cloud computing, artificial intelligence technology can be used to automatically identify and deal with an abnormal condition and a change in environment through machine learning algorithm and data comparison technology, so as to improve intelligent degree of the whole system.

The Internet cloud system accepts data processor information and the communication module can be used for remote control.

The electrical controller is used to control the cooling and noise reduction equipment according to the data transmitted in real time by data conduction module.

The cooling and noise reduction equipment includes a ventilation fan, a muffler louver, and a mechanical and electrical device.

In an embodiment of the present disclosure, the monitoring module includes a dynamic monitoring module for air pressure and wind speed, a dynamic monitoring module for temperature, and a dynamic monitoring module for noise.

In an embodiment of the present disclosure, the sensor includes an air pressure wind speed sensor, a temperature sensor, and a sound level meter sensor.

In an embodiment of the present disclosure, the communication equipment is used to receive real-time data transmitted by the monitoring module and uploading it to the internet cloud system.

In an embodiment of the present disclosure, the data processor stores Chinese and international noise emission standard data, and includes a temperature data memory; an artificial intelligence, a cloud computing and artificial intelligence technology can be used to automatically identify and process an abnormal condition and a change of environment through machine learning algorithm and data comparison technology, so as to improve the intelligent degree of the whole system.

In an embodiment of the present disclosure, the temperature dynamic monitoring module is provided with an opening point of an ambient temperature value and a closing point of an ambient temperature value.

In an embodiment of the present disclosure, each mechanical shaft rotation module is provided with a noise upper and lower limit to open the rotation point.

In an embodiment of the present disclosure, the opening point of the ventilation fan is set at 40 degrees Celsius and the closing point of the ambient temperature value is set at 25 degrees Celsius.

In an embodiment of the present disclosure, the cooling and noise reduction equipment includes an installation frame, a fan, a control electric box, a driving device, a noise reduction mechanism, and a monitoring assembly. The noise reduction mechanism is provided in the installation frame, the monitoring component is provided on an outside of the installation frame, and the driving device is provided on one side of the installation frame. The driving device is connected with the noise reduction mechanism. One side of the installation frame away from the monitoring assembly is provided with the fan, and one side of the installation frame away from the driving device is provided with the control electric box. An outside of the control electric box is hinged with a door plate, and the door plate is provided with a door lock.

In an embodiment of the present disclosure, the driving device includes an electric push rod, a telescopic member, a connection member, a connection rod and a toggle rod. The electric push rod is installed on one side of the installation frame which is away from the fan, and the electric push rod is further provided with the telescopic member. The telescopic member is provided with the connection rod through the connection member; the connection rod is provided with a plurality of toggle rods, and the toggle rod is connected with the noise reduction mechanism.

In an embodiment of the present disclosure, the noise reduction mechanism includes a plurality of fixed modes, a muffler chip, a connection block and a rotation shaft. Outsiders of each fixed mode is fixedly connected with the rotation shaft, and are provided with a plurality of connection blocks, the connection block corresponds to the toggle rod, respectively. The fixed modes are rotationally connected by a rotation shaft on an inner side of the installation frame and are symmetrically distributed inside the installation frame. A spindle shaped muffler chip is arranged between these symmetrically distributed fixed modes, and one side of the muffler chip near the fan is provide with a plurality of through holes.

In an embodiment of the present disclosure, the monitoring assembly includes a sound level meter sensor, a pressure and wind speed sensor, and a temperature sensor. One side of the installation frame away from the fan is successively provided with a noise sensor, a wind speed sensor and a temperature meter. The noise sensor, wind speed sensor and temperature meter are electrically connected with the control electric box, respectively.

Through the above technical scheme, compared with the existing technology, the present disclosure innovatively combines the most advanced intelligent control information technology with the integration of environmental protection, energy saving and noise reduction technology, and innovatively solves the environmental pollution problems of heat emission and noise emission in the operation of equipment and the low efficiency of manual management. It also integrates the design of online temperature and noise dynamic monitoring, data conduction, communication induction, and joints control regulation, automatic control, and realizes a self-adaptive environment intelligent electric regulation control of heat dissipation and ventilation noise reduction information control system. Combined with the advantages of the internet cloud system, it can realize real-time online monitoring, induction, conduction communication, intelligent linkage control, remote guidance and service, fully reflect the characteristics of high intelligence, information technology, efficient interconnection and control, and maximize the protection of the function and life cycle of the equipment and the health and comfort of the living environment.

The intelligent control and ventilation energy-saving and noise reduction system based on cloud system is composed of multiple components, including a sensor, a communication equipment, a data processor, a controller, and a cooling and noise reduction equipment. Among them, the sensor is the core of the whole system, which can monitor the noise status, thermal environment status and other information of indoor environment in real time, so as to realize the intelligent control and optimization of the cooling and noise reduction equipment. The communication equipment can transmit data collected by the sensor to the controller and the data processor to realize rapid transmission and sharing of information. According to the data collected by the sensor, the controller can automatically adjust the cooling wind speed of the cooling and noise reduction equipment, the direction and angle of the noise reduction blade, and improve the accuracy and safety matching of noise reduction and energy saving efficiency. The data processor can analyze and process the collected data and provide signals to the controller and joint control support. The cooling and noise reduction equipment and personnel management system can monitor the noise status and thermal environment status of the indoor environment in real time, and provide effective management and control.

BRIEF DESCRIPTION OF DRAWINGS

In order to more clearly state the technical scheme in embodiments of the present disclosure or technical scheme in the prior art, the drawings required to be used in the description of the embodiments or the prior art are briefly introduced below. Obviously, the attached drawings described below are only a part of embodiments of the present disclosure, and other drawings can be obtained according to the provided attached drawings without creative labor for ordinary technicians in the field.

1—installation frame, 2—fan, 3—control electric box, 301—door plate, 302—door lock, 4—electric push rod, 401—telescopic member, 402—connection member, 403—connection rod, 404—toggle rod, 5—fixed mode, 501—muffler chip, 502—connection block, 503—rotation shaft, 6—noise sensor, 7—wind speed sensor, 8—thermometer.

DESCRIPTION OF EMBODIMENTS

In the following, the technical scheme in the embodiment of the present disclosure is described clearly and completely in combination with the attached drawings in the embodiment of the present disclosure. Obviously, the described embodiment is only a part of embodiments of the present disclosure, but not the whole embodiments. Based on the embodiments of the present disclosure, all other embodiments obtained by ordinary technicians in the field without creative labor shall fall within the scope of the protection of the present disclosure.

Embodiment 1

Figure 1:
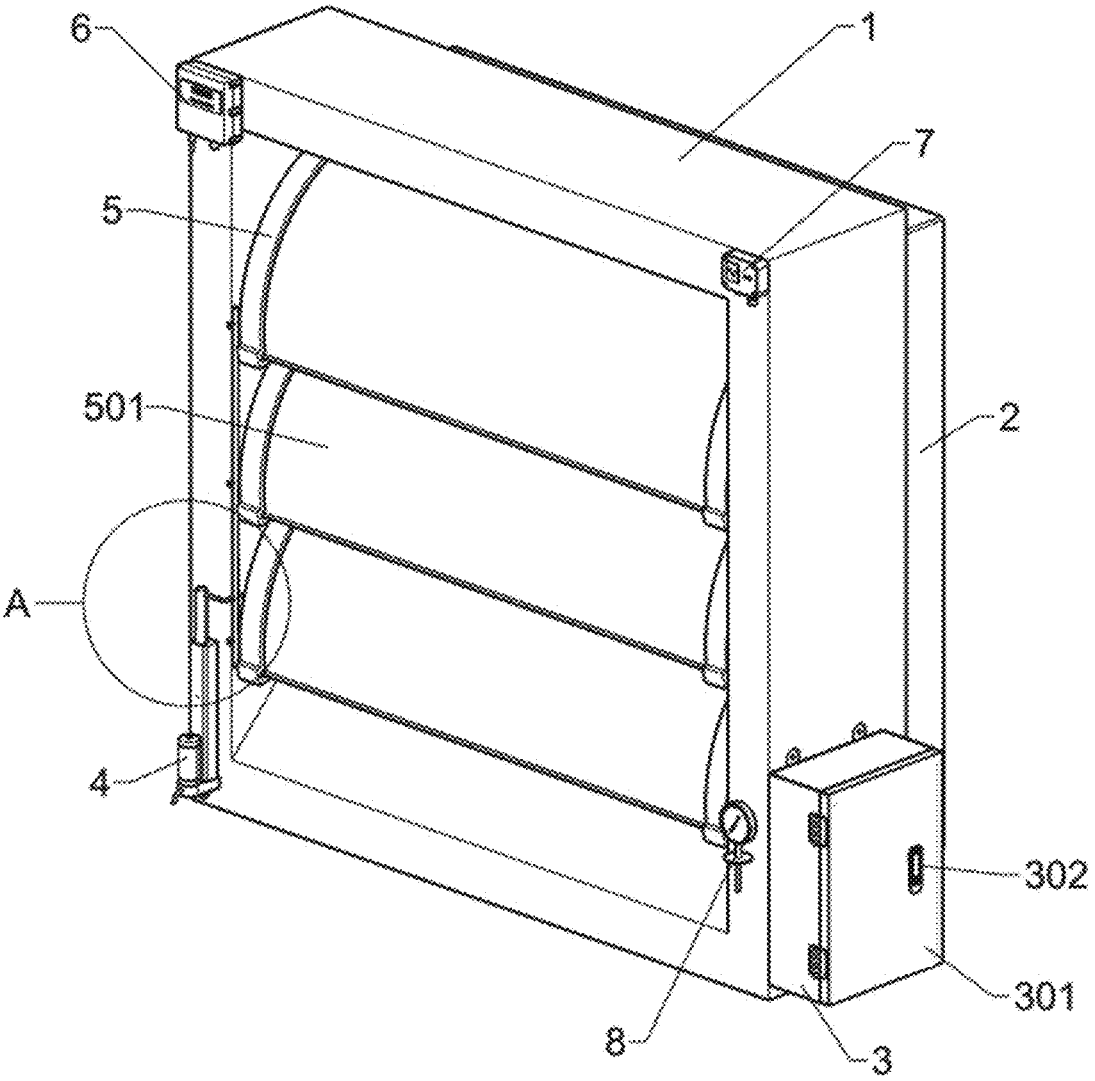
FIG. 1 shows a schematic diagram of a three-dimensional structure of Embodiment 2 of the present disclosure.
Figure 2:
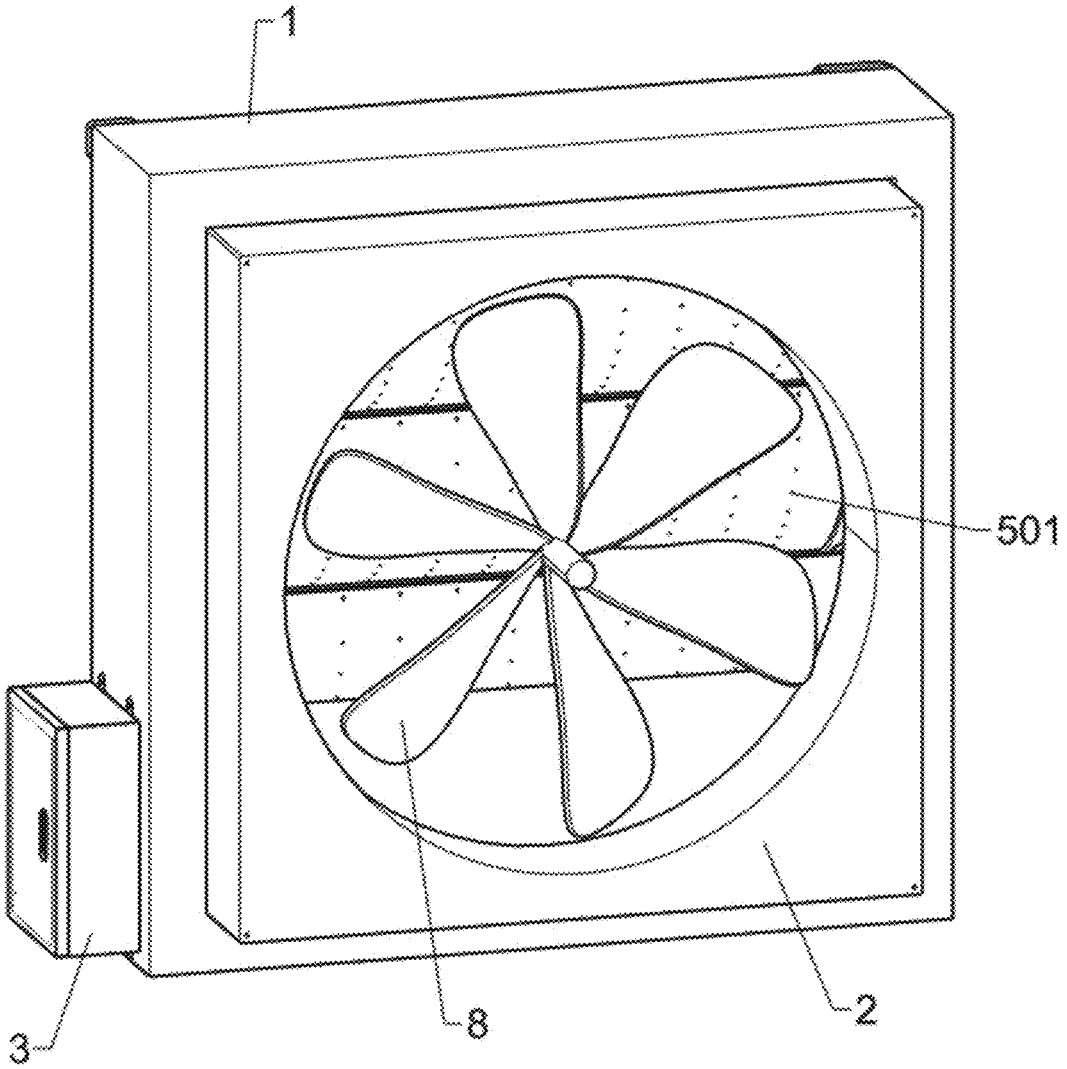
FIG. 2 shows a schematic of the three-dimensional structure from a rear side of Embodiment 2 of the present disclosure.
Figure 3:
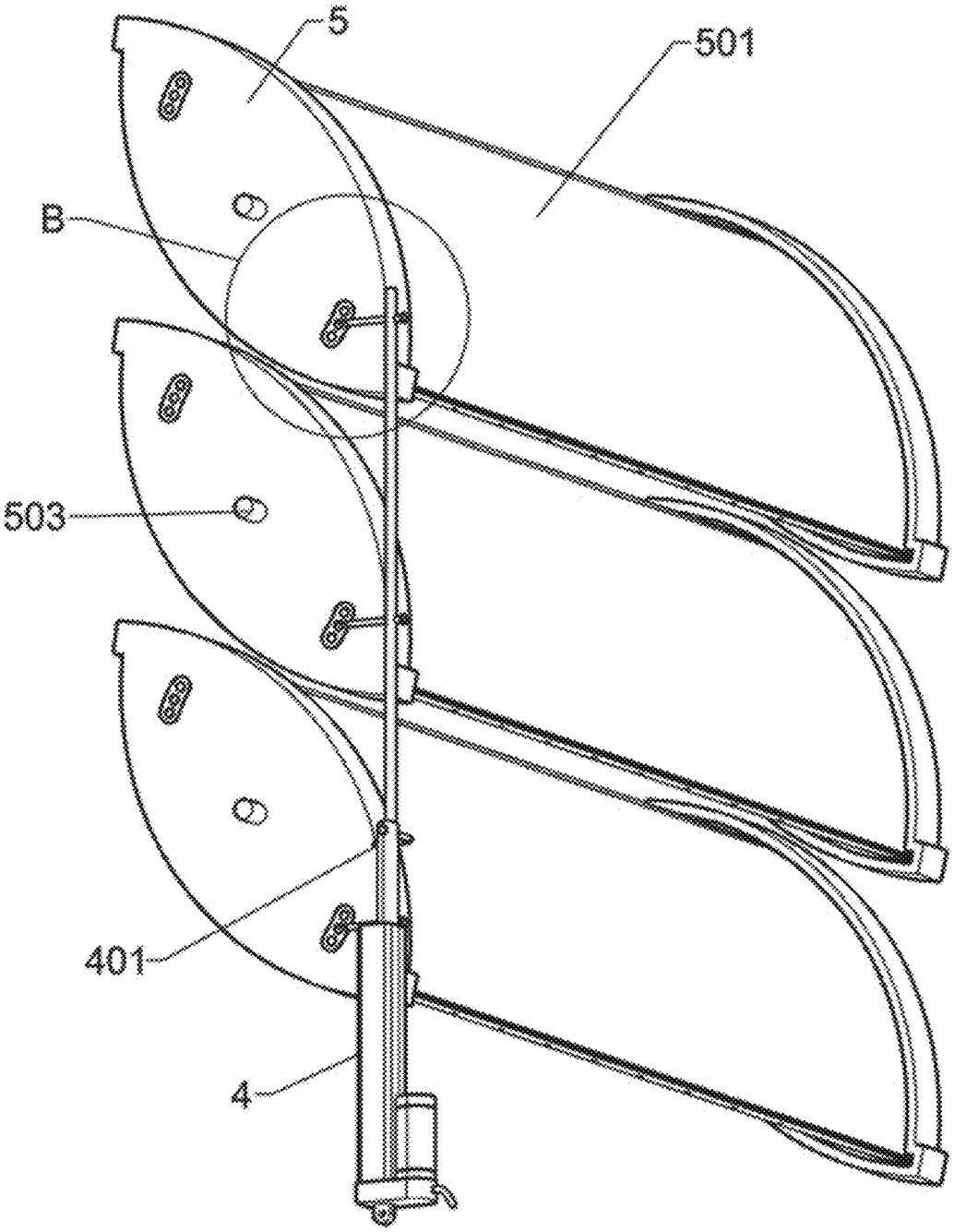
FIG. 3 shows a schematic diagram of a connection relationship between a mechanical driving device and a noise reduction mechanism of Embodiment 2 of the present disclosure.
Figure 4:
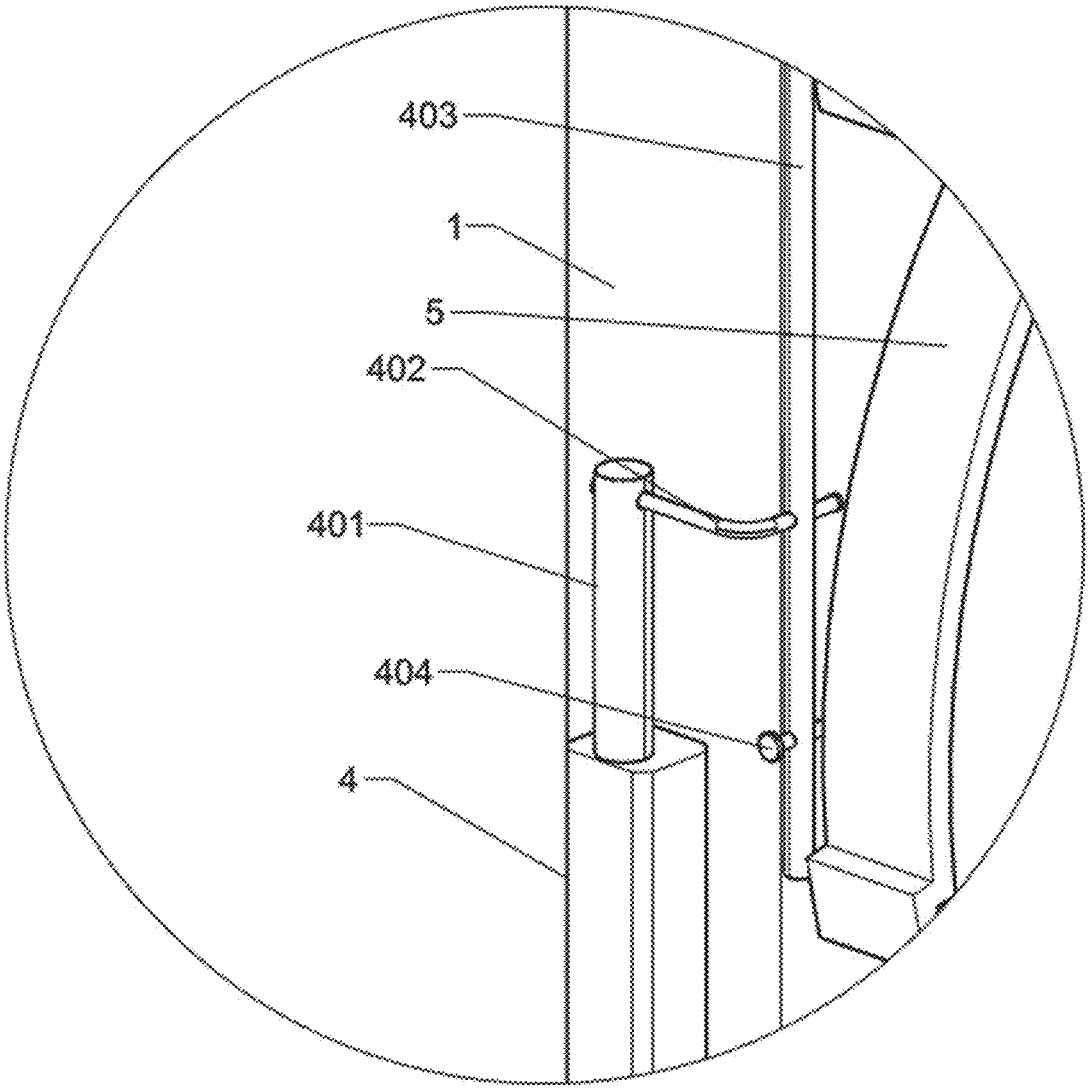
FIG. 4 shows an enlarged view at A of Embodiment 2 of the present disclosure.
Figure 5:
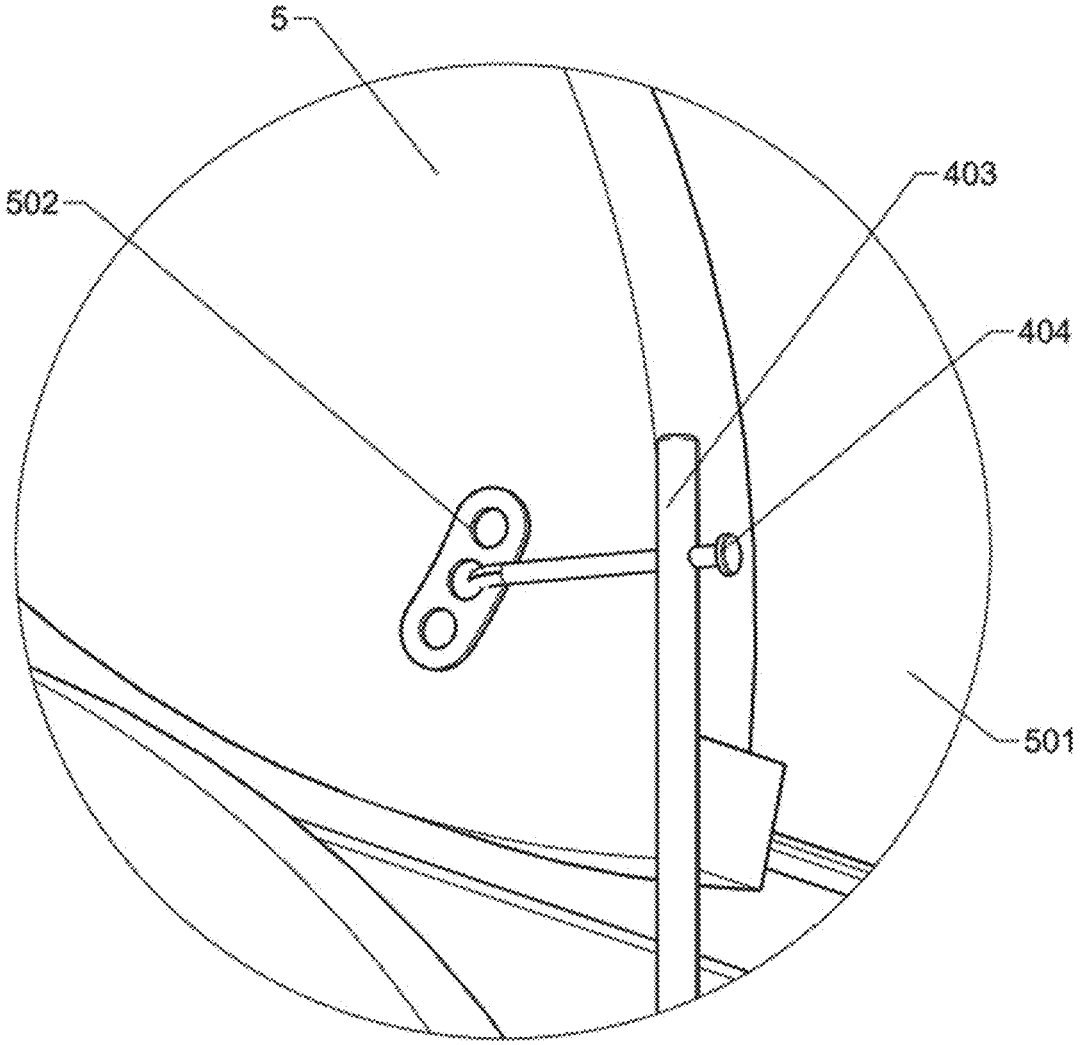
FIG. 5 shows an enlarged view at B of Embodiment 2 of the present disclosure.
Figure 6:
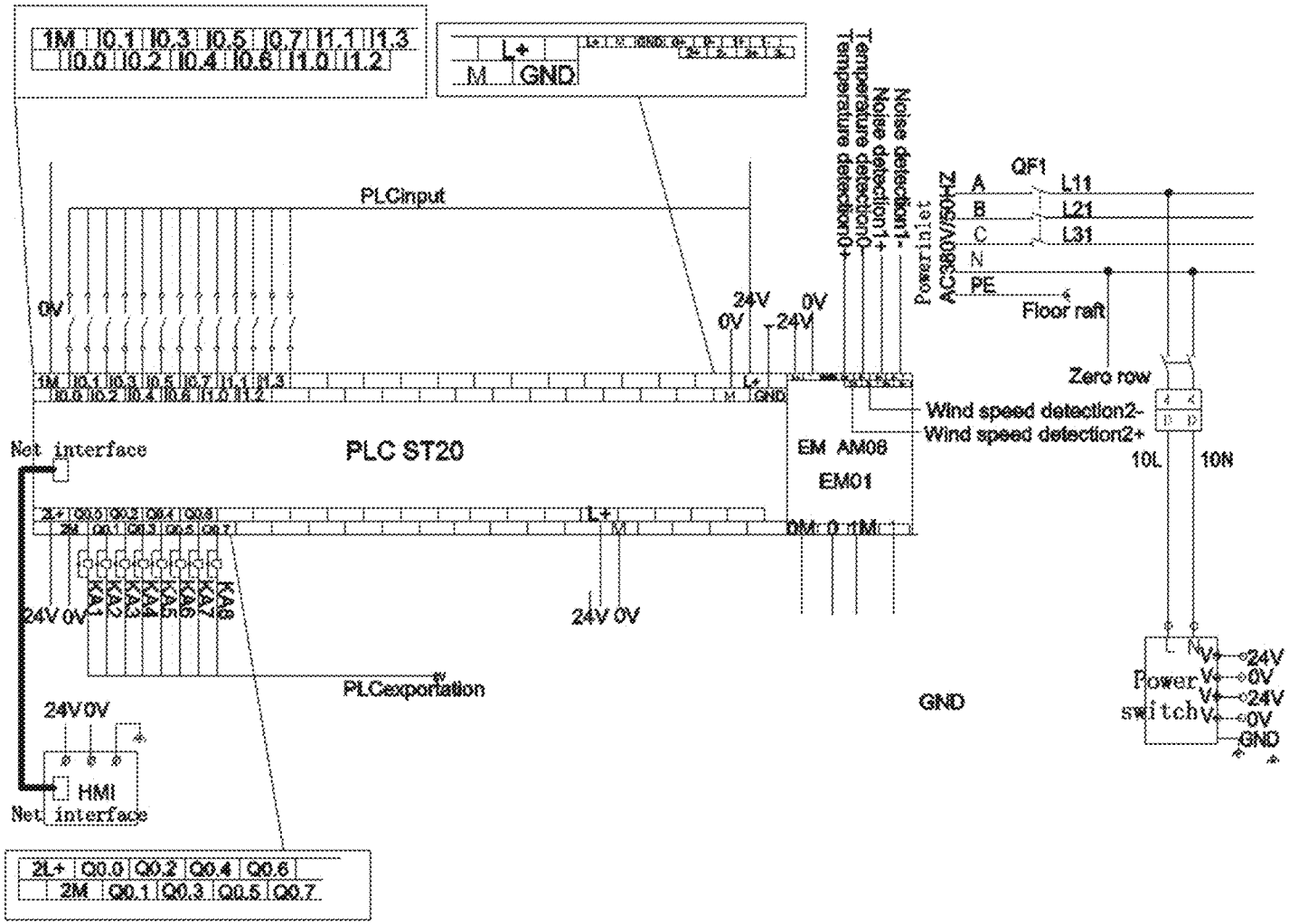
FIG. 6 shows an electrical control schematic diagram of Embodiment 1 of the present disclosure.

As shown in FIG. 6, an intelligent control and ventilation energy-saving muffler system based on cloud system includes the following functional components: a sensor, a communication equipment, a controller, a data processor, an internet cloud system, an electrical controller, and a cooling and noise reduction equipment.

The intelligent control and ventilation energy-saving muffler system based on cloud system further includes a monitoring module, which is used for dynamic monitoring pressure, temperature, and noise.

The sensor includes a pressure sensor, a temperature sensor, and a sound level meter sensor.

The communication equipment receives real-time data transmitted by the monitoring module and upload it to the internet cloud system.

The data processor stores Chinese and international noise emission standard data and includes a temperature data storage; an artificial intelligence, a cloud computing, artificial intelligence technology can be used to automatically identify and deal with an abnormal condition and a change in environment through machine learning algorithm and data comparison technology, so as to improve intelligent degree of the whole system.

The Internet cloud system accepts data processor information and the communication module be used for remote control.

The electrical controller is used to control the cooling and noise reduction equipment according to the data transmitted in real time by data conduction module.

The cooling and noise reduction equipment includes a ventilation fan, a muffler louver, and a mechanical and electrical device.

In order to further optimize the above scheme, the monitoring module includes a dynamic monitoring module for air pressure, wind speed, temperature and noise.

In order to further optimize the above scheme, the data processor stores the numerical values of Chinese and international acoustic environment specifications, calculates intelligentially, automatically responses the controller, and uploads the communication to the cloud system, which can realize manual or remote control services.

In order to further optimize the above scheme, the temperature dynamic monitoring module is respectively equipped with an opening point of an ambient temperature value and a closing point of the ambient temperature value.

In order to further optimize the scheme, each mechanical shaft rotation module is respectively provided with a noise upper and lower limit to open the rotation point.

In order to further optimize the above scheme, the opening point of the ventilation fan is set at 40 degrees Celsius, and the closing point of the ambient temperature value is set at 25 degrees Celsius.

The present disclosure provides an innovative technology for intelligent electric regulation and control of heat, ventilation and noise reduction that can match the environment of real-time wind power or energy storage equipment (fan 2, new energy charging station energy storage equipment, large data center exchange unit, boiler, fan equipment room, large cooling system and other equipment) under the operating state. The integrated muffler system consists of a cooling fan 2, a ventilation muffler, a thermometer 8, a noise sensor 6 and an electrical controller. It can be installed on the equipment or a wall of an equipment room. The cooling fan 2 can control whether to start according to the real-time thermal environment (temperature sensor induction) state, and set an ambient temperature value to start (40 degrees Celsius) and close (25 degrees Celsius). If the temperature is higher than the set temperature, the cooling fan 2 will start to exhaust air for heat dissipation; if it is lower than the set temperature, the fan 2 will automatically shut down. The muffler is mainly a noise reduction design. The muffler is composed of an intermediate rotation shaft 503 mechanism and a muffler chip 501 that can be rotated along the rotation shaft 503. An angle of the muffler chip 501 can be automatically adjusted according to the real-time acoustic ambient noise (noise sensor 6 induction) state, thus improving the noise reduction effect. Thus, it can better ensure the reduction of noise radiation and heat accumulation pollution to the environment, and achieve an optimal match of energy conservation, noise reduction and temperature regulation.

Embodiment 2

The cooling and noise reduction equipment, as shown in FIGS. 1-5, includes an installation frame 1, a fan 2, a control electric box 3, a driving device, a noise reduction mechanism, and a monitoring assembly. The installation frame 1 is provided with a muffling mechanism, and an outside of the installation frame 1 is provided with a monitoring assembly. One side of the installation frame 1 is provided with a driving device, which is connected with the noise reduction mechanism. One side of the installation frame 1 away from the monitoring assembly is provided with a fan 2 and one side of the installation frame 1 away from the driving device is provided with a control electric box 3. An outer side of the control electric box 3 is hinged with a door plate 301, and a door lock 302 is provided on it.

To further optimize the scheme, the driving device includes an electric push rod 4, a telescopic member 401, a connection member 402, a connection rod 403 and a toggle rod 404. The electric push rod 4 is installed on one side of the installation frame 1 away from the fan 2. The electric push rod 4 is provided with the telescopic member 401. The telescopic member 401 is provided with a connection rod 403 through a connection member 402, and the connection rod 403 is provided with a plurality of toggle rods 404, the toggle rod 404 is connected with the noise reduction mechanism.

To further optimize the scheme, the noise reduction mechanism includes a plurality of fixed modes 5, a muffler chip 501, a connection block 502 and a rotation shaft 503. Outsiders of each fixed mode 5 is fixedly connected with the rotation shaft 503, and is provided with a plurality of connection blocks 502. The connection block 502 corresponds to the toggle rod 404, respectively. The fixed modes 5 are connected to an inside of the installation frame 1 by the rotation shaft 503 and are symmetrically distributed inside the installation frame 1. The symmetric distributed fixed modes 5 are arranged between the muffler chip 501, the muffler chip 501 is in a spindle shape, and one side near the fan 2 is provided with a plurality of through holes.

To further optimize the above scheme, the monitoring assembly includes a noise sensor 6, a wind speed sensor 7, and a thermometer 8. One side of the mounting frame 1 away from the fan 2 is successively provided with the noise sensor 6, the wind speed sensor 7 and the thermometer 8. The noise sensor 6, wind speed sensor 7 and thermometer r 8 are electrically connected with the control electric box 3, respectively.

The present disclosure provides a technical solution for intelligent electric regulation control of heat dissipation and ventilation noise reduction that can match the environment under the running state of real-time wind, cold power or energy storage equipment (fan 2, new energy charging station energy storage equipment, large data center exchange unit, boiler and other equipment). The integrated muffler system equipment is composed of the cooling fan 2, muffler mechanism, thermometer 8, noise sensor 6 and electrical controller. It can be installed on the equipment or equipment room wall. The cooling fan 2 controls whether to start according to the real-time thermal environment (temperature sensor induction) state, and set an environmental temperature value opening (40 degrees Celsius) and closing point (25 degrees Celsius). If the temperature is higher than the set temperature, the cooling fan 2 will be started for exhaust and heat dissipation. If the temperature is lower than the set temperature, the fan 2 will be automatically closed. The ventilation muffler is mainly designed for muffling and noise reduction. The muffler is composed of the rotation shaft 503 mechanism and muffler chip 501 that can rotate along the rotation shaft 503. The angle of the muffler chip 501 can be automatically adjusted and controlled according to the real-time noise level of the acoustic environment (noise sensor 6 induction), so as to improve the muffling effect. In this way, the environmental pollution caused by noise radiation and heat accumulation can be reduced, and the optimal matching of energy saving, noise reduction and temperature regulation can be achieved. At the same time, the innovative technology is more combined with the current intelligent information development direction, greatly improve the accuracy and safety of noise reduction and energy saving efficiency, and finally achieve an intelligent automation upgrade of environmental protection noise reduction and energy saving intelligent manufacturing technology.

Each embodiment in this specification is described in a progressive manner, and each embodiment focuses on its differences from other embodiments. The same and similar parts of each embodiment can be referred to each other. For the device disclosed by the embodiment, because it corresponds to the method disclosed by the embodiment, the description is relatively simple, and the relevant points can be described in the method section.

The foregoing description of the disclosed embodiment enables professional technicians in this field to implement or use the present disclosure. Various modifications of these embodiments will be apparent for those skilled in the art, and the general principles defined herein may be implemented in other embodiments without departing from the spirit or scope of the present disclosure. Therefore, the present disclosure will not be restricted to these embodiments shown herein, but will conform to the widest scope consistent with the principles and novel features disclosed herein.

What is claimed is:

1. An intelligent control and ventilation energy-saving muffling system based on cloud system, comprising: a monitoring module, sensors, communication equipment, a controller, a data processor, an internet cloud system, an electrical controller, and a cooling and noise reduction equipment;

wherein the monitoring module is used for dynamic monitoring pressure, temperature and noise;

wherein the monitoring module comprises a pressure sensor, a temperature sensor, and a sound level meter sensor;

the communication equipment receives real-time data transmitted by the monitoring module and uploads it to the internet cloud system;

the data processor stores Chinese and international noise emission standard data and includes a temperature data storage; a cloud computing and an artificial intelligence are used to identify an abnormal condition in environment through machine learning algorithm and data comparison technology;

the Internet cloud system accepts data processor information and the communication module is used for remote control;

the electrical controller is used to control the cooling and noise reduction equipment according to the data transmitted in real time by data conduction module; and the cooling and noise reduction equipment includes a ventilation fan, a muffler louver, and a mechanical and electrical device;

wherein the cooling and noise reduction equipment comprises an installation frame, a fan, a control electrical box, a driving device, a noise reduction mechanism, and a monitoring assembly;

wherein the driving device comprises an electric push rod, a telescopic member, a connection member, a connection rod and a toggle rod;

wherein the noise reduction mechanism comprises a plurality of fixed modes, a muffler chip, a connection block and a rotation shaft;

the monitoring assembly comprises a noise sensor, the wind speed sensor and a thermometer.

2. The intelligent control and ventilation energy-saving muffling system according to claim 1, wherein the cloud computing and an artificial intelligence are provided environmental temperature numerical opening point and an environmental temperature numerical closing point.

3. The intelligent control and ventilation energy-saving muffling system according to claim 2, wherein a temperature to turn on the fan is set at 40 degrees Celsius, and a temperature to turn off the fan is set at 25 degrees Celsius.

4. The intelligent control and ventilation energy-saving muffling system according to claim 1, wherein the installation frame is provided with the noise reduction mechanism inside the installation frame; one side of the installation frame is provided with the driving device, and the driving device is connected with the noise reduction mechanism, and the fan is provided on one side of the installation frame away from the monitoring assembly;

opposite side of the installation frame from side that the driving device is mounted is provided with the control electric box; an outer side of the control electric box (3) is hinged with a door plate mounted externally onto the installation frame, and the door plate is provided with a door lock.

5. The intelligent control and ventilation energy-saving muffling system according to claim 4, wherein the electric push rod is installed on one side of the installation frame which is away from the fan; the electric push rod is further provided with the telescopic member, the telescopic member is provided with the connection rod through the connection member, and the connection rod is provided with a plurality of toggle rods, the toggle rod is connected with the noise reduction mechanism.

6. The intelligent control and ventilation energy-saving muffling system according to claim 5, wherein outsiders of each fixed die is fixedly connected with the rotation shaft, and are provided with a plurality of connection blocks, the connection block corresponds to the toggle rod, respectively; the fixed modes are rotationally connected through the rotation shaft on an inside of the installation frame and are symmetrically distributed inside the installation frame; and a muffler chip is arranged between the symmetrically distributed fixed modes, and the muffler chip is in a spindle shape, and one side of the muffler chip near the fan is provided with a plurality of through holes.

7. The intelligent control and ventilation energy-saving muffling system according to claim 4, wherein the noise sensor, wind speed sensor, and the thermometer are arranged on one side of the installation frame away from the fan; and the noise sensor, wind speed sensor and thermometer are respectively electrically connected to the control electrical box.

* * * * *